US006439130B1

(12) United States Patent
Scheffel

(10) Patent No.: US 6,439,130 B1
(45) Date of Patent: Aug. 27, 2002

(54) SELF-STEERING BOGIES

(76) Inventor: Herbert Scheffel, 93a Van Wouw Street, Groenkloof 0181 (ZA)

( * ) Notice: Subject to any disclaimer, the term of this patent is extended or adjusted under 35 U.S.C. 154(b) by 0 days.

(21) Appl. No.: 09/762,490

(22) PCT Filed: Aug. 4, 1999

(86) PCT No.: PCT/IB99/01383

§ 371 (c)(1),
(2), (4) Date: Apr. 5, 2001

(87) PCT Pub. No.: WO00/07864

PCT Pub. Date: Feb. 17, 2000

(30) Foreign Application Priority Data

| | | |
|---|---|---|
| Aug. 6, 1998 | (ZA) | 98/7069 |
| Aug. 6, 1998 | (ZA) | 98/7070 |
| Mar. 29, 1999 | (ZA) | 99/2395 |

(51) Int. Cl.[7] ..... B61F 5/00
(52) U.S. Cl. ..... 105/167
(58) Field of Search ..... 105/182.1, 165, 105/167, 168, 164, 166, 199.1, 210, 224.1, 176, 218.1

(56) References Cited

U.S. PATENT DOCUMENTS

| | | | | | |
|---|---|---|---|---|---|
| 1,954,705 | A | * | 4/1934 | Kruckenberg et al. | 105/168 |
| 4,134,343 | A | * | 1/1979 | Jackson | 105/167 |
| 4,151,801 | A | | 5/1979 | Scheffel et al. | 105/168 |
| 4,300,454 | A | | 11/1981 | Scheffel | 105/168 |
| 4,660,476 | A | * | 4/1987 | Franz | 105/168 |
| 4,679,507 | A | | 7/1987 | Rassaian | 105/136 |
| 4,742,780 | A | * | 5/1988 | Waddington | 105/168 |
| 5,024,165 | A | * | 6/1991 | Panagin | 105/168 |
| 5,235,918 | A | * | 8/1993 | Durand et al. | 105/168 |
| 5,277,127 | A | * | 1/1994 | Euwijk et al. | 105/176 |
| 5,647,283 | A | | 7/1997 | McKisic | 105/167 |

* cited by examiner

*Primary Examiner*—S. Joseph Morano
*Assistant Examiner*—Lars A. Olson
(74) *Attorney, Agent, or Firm*—Conley, Rose & Tayon, P.C.

(57) ABSTRACT

The invention concerns an inter-axle shear stiffening apparatus for a self-steering rail bogie and a self-steering rail bogie equipped with such apparatus. The apparatus has axle structures including axles (16, 16.1) which are journalled in axle box bearings (20, 20.1). Radial arms (30, 30.1) are connected rigidly to respective axle structures of the bogie an extend towards one another in a fore and aft direction. A lateral force transmitting device (60) acts between the arms to transmit lateral forces between them while accommodating relative lateral movement between them. The design of this device is such that, irrespective of the extent of relative movement between the arms, the device can only transmit between them lateral forces of limited, predetermined magnitude. This value is chosen such that the bogie is provided with sufficient inter-axle shear stiffness to enhance its hunting stability without excessive force couples being applied to the axle box bearings.

18 Claims, 15 Drawing Sheets

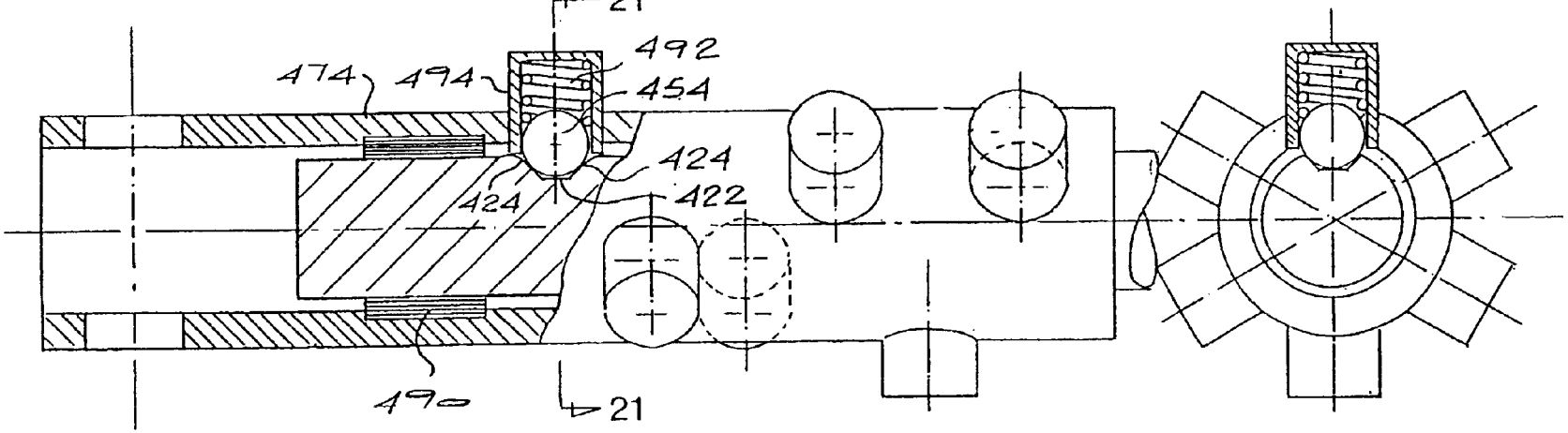
21
20
21
492
454
424
422
21
494
424
474
490

SELF-STEERING BOGIES

BACKGROUND TO THE INVENTION

THIS invention relates to self-steering bogies for rail vehicles and in particular to the provision of inter-axle shear stiffness in self-steering bogies.

Inter-axle shear stiffness for self-steering bogies is commonly provided by means of cross-anchors which are fitted to the wheelset sub-frames, as proposed for instance in the known Scheffel cross-anchor design, or by means of A-frames which are connected to one another, at their apices, on the transverse centre line of the bogie, as proposed for instance in the known List Steering Arm design. However, on irregular track, and particularly at points and crossings, high shock loads are exerted on the wheelsets and transmitted to the sub-frames or A-frames. The frames must therefore be robust. Robustness is also necessary to ensure that the forces transmitted to the frames do not generate unduly high force couples on the journal roller bearings of the bogie wheelsets which could shorten the service life of those bearings. The required robustness results in heavy sub-frames or A-frames which considerably increase the unsprung wheelset mass and this can in turn reduce the hunting stability of the bogie at high speeds.

It is however understood that the inter-axle shear forces which are required to ensure effective wheelset guidance for hunting stability and curving performance are only a fraction, typically no more than 30%, of the shock forces encountered at points and crossings.

Against this background the present invention proposes to provide an apparatus which will limit the transmission of shear forces between the wheelsets to a level at which adequate hunting stability and curving performance can be attained but which will nevertheless be acceptable to the wheel journal roller bearings.

SUMMARY OF THE INVENTION

According to one aspect of the invention there is provided an inter-axle shear stiffening apparatus for a self-steering rail bogie having axle structures including axles which are journalled in axle box bearings, the apparatus comprising arms which are rigidly connected or connectable to respective axle structures of the bogie to extend towards one another from the axle structures in generally fore and aft directions, and lateral force transmitting means for acting between the arms to transmit lateral forces between them while accommodating relative lateral movement between the arms, wherein, irrespective of the extent of relative movement between the arms, the lateral force transmitting means is only capable of transmitting between them lateral forces of limited, predetermined magnitude which provide the bogie with inter-axle shear stiffness to enhance hunting stability of the bogie but are insufficient to impose excessive force couples on the axle box bearings.

According to another aspect of the invention there is provided a self-steering rail bogie having axle structures including axles journalled in axle box bearings and including an inter-axle shear stiffening apparatus as summarised above, with the arms of the apparatus rigidly connected to the axle structures and the apparatus providing inter-axle shear stiffness to enhance the hunting stability of the bogie.

Other advantageous and preferred features of the invention are set forth in the appended claims.

BRIEF DESCRIPTION OF THE DRAWINGS

The invention will now be described in more detail, by way of example only, with reference to the accompanying drawings in which:

FIGS. 17 to 21 illustrate different force transmitting devices with a degressive characteristic;

DESCRIPTION OF EMBODIMENTS

Figure 1:
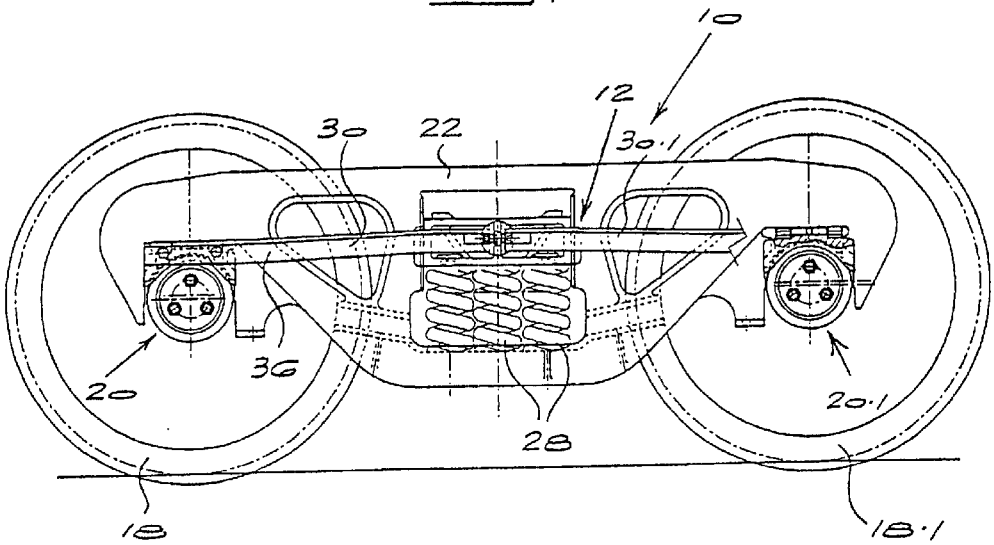
FIG. 1 shows a side view of a bogie retro-fitted with an apparatus according to the invention.
Figure 2:
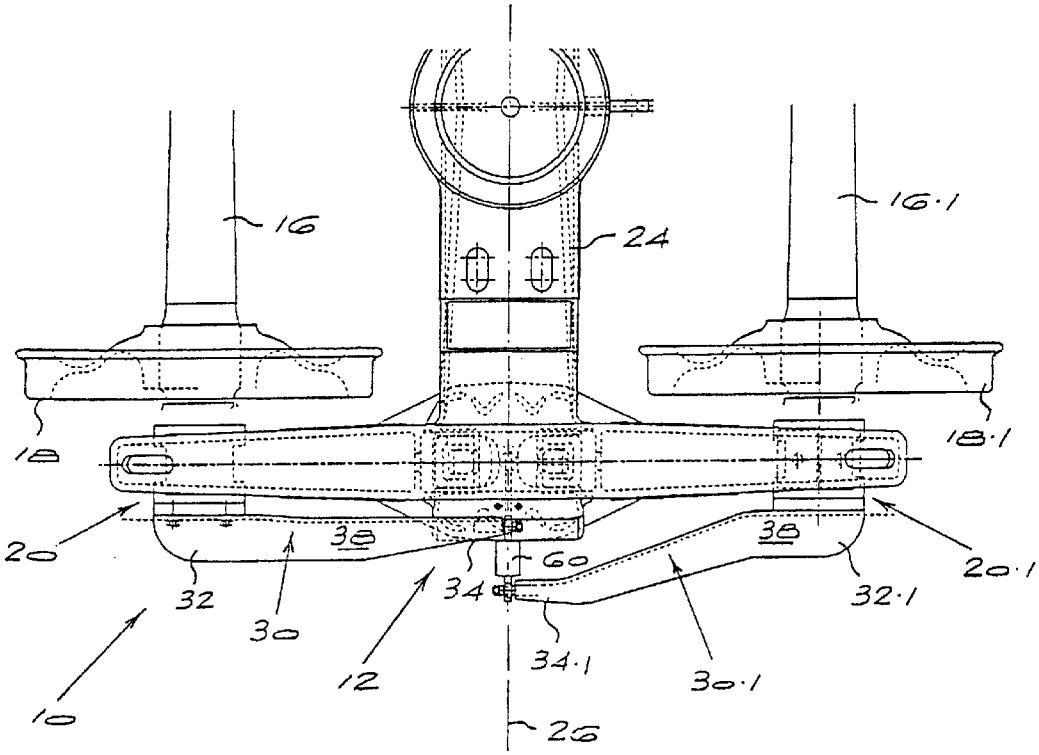
FIG. 2 shows a plan view of one side of the bogie.
Figure 3:
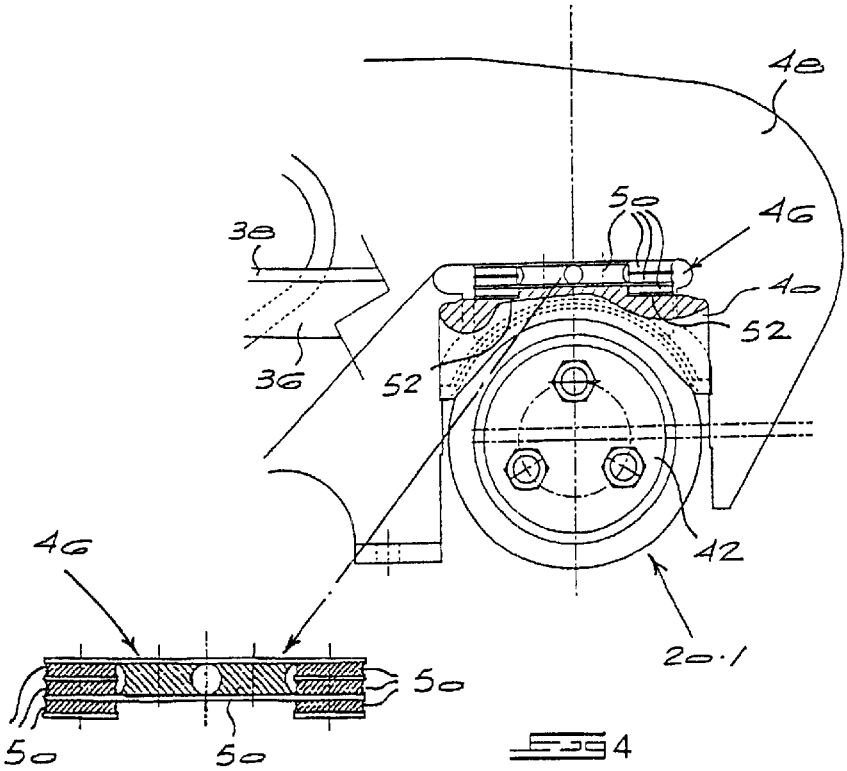
FIG. 3 shows a detail of a bearing adaptor of the apparatus.

FIGS. 1 to 3 illustrate a three-piece self-steering rail bogie 10 to which an apparatus 12 according to the present invention has been retro-fitted to provide inter-axle shear stiffness between the axles 16, 16.1 of the bogie. As is conventional, wheels 18, 18.1 are fast with the axles 16, 16.1 of the bogie 10. The axles are supported in respective axle boxes 20, 20.1, located outboard of the wheels, by the usual journal roller bearings. Side frames 22 are suspended on the axle boxes 20, 20.1 and support a transverse bolster 24, on the transverse centre line 26 of the bogie, by means of springs 28.

The apparatus 12 of the invention includes, on each side of the bogie, a pair of arms 30, 30.1. The arms are oriented generally in a fore and aft direction. First ends 32, 32.1 of the arms are connected to the respective axle boxes 20, 20.1 while the opposite, second ends 34, 34.1 of the arms lie near to one another on the transverse centre line 26. The arms 30, 30.1 are appropriately shaped lengths of angle section steel with one leg 36 of the angle section vertical and the other leg 38 thereof horizontal.

The manner in which the first ends 32, 32.1 of the arms are connected to the axle boxes 20, 20.1 is now described with particular reference to FIG. 3 of the drawings. The apparatus 12 includes, for each axle box, a bearing adaptor 40 which is mounted on the journal bearing 42 of the axle box and to which the vertical legs 36 of the arms are connected by bolts, welding, riveting, lock-bolting or other suitable means (not shown).

The apparatus 12 also includes, for each bearing adaptor, a shear pad assembly 46 which is located between the adaptor and side frame 22, within the pedestal 48 of the side frame. In this embodiment, the shear pad assembly 46 comprises a number of individual, relatively thin rubber shear pads 50. The upper surface of the bearing adaptor 40 is formed with steps 52, this being allowed by the curvature of the lower surface of the bearing adaptor which bears on the journal roller bearing 42 of the axle box. Whereas the available space in the pedestal opening between the bearing 42 and the pedestal 48 may allow for only a single shear pad 50 to be placed on the vertical centre line of the bearing in the retro-fit application under discussion, the steps 52 provide space to accommodate stacks of shear pads at positions fore and aft of the centre line.

The multiple shear pad arrangement allows for appropriate levels of spring stiffness to be provided between the journal box and pedestal even in the limited space available in a conventional bogie. In particular the arrangement allows longitudinal spring stiffness to be reduced in order to improve the curving, i.e. self-steering, ability of the bogie. Although only a single step 52 is shown on each side of the roller bearing centre line in FIG. 3, it should be understood that there may be several such steps on each side, allowing for the placement of increasing numbers of individual shear pads with increasing distance from the vertical roller bearing centre line. This in turn can allow for variations to be made in the level of shear stiffness of the pedestal mounting.

Figure 25:
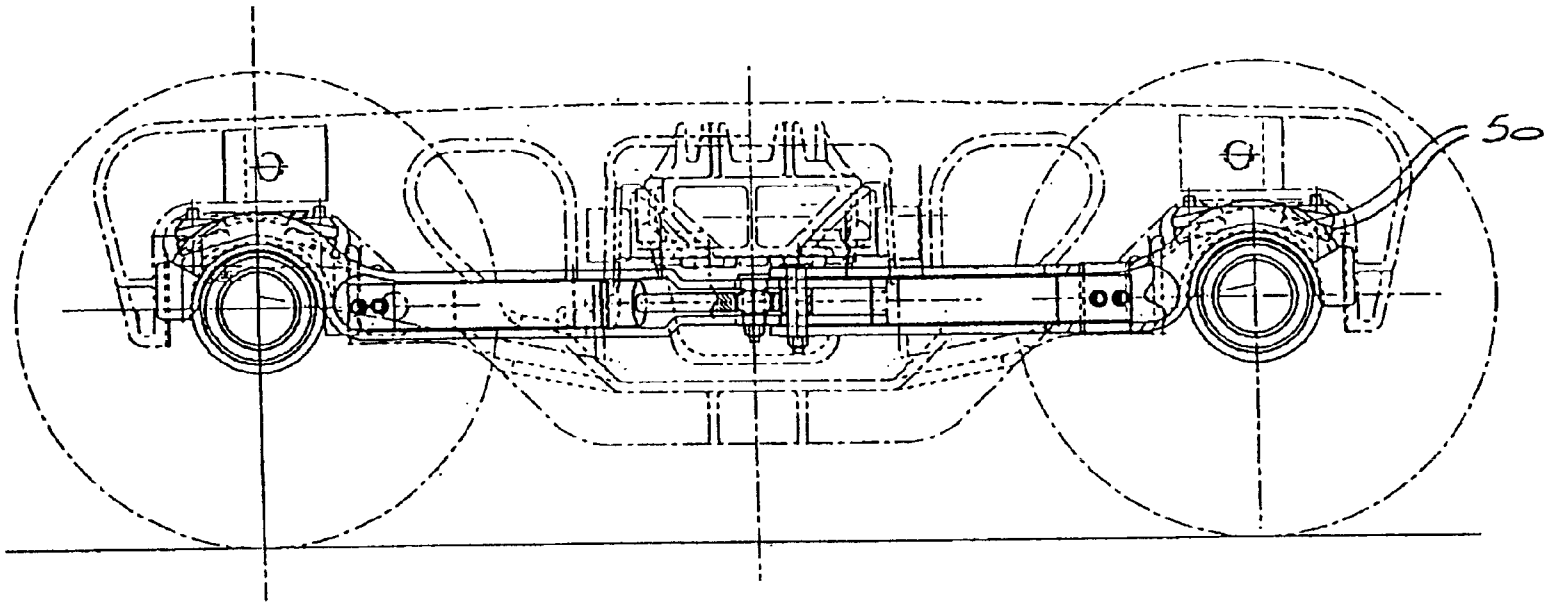
FIG. 25 shows a side view of a three-piece bogie and illustrates an alternative axlebox suspension arrangement.

It is however recognised that an inherent problem with a multi-step, multiple shear pad configuration as proposed above is the potential difficulty in ensuring that the pads in the various layers and stacks are equally loaded. In an alternative arrangement, shown in FIG. 25, pairs of inclined rubber pads 50 are provided in a configuration which will be less susceptible to unequal loading to give the appropriate levels of longitudinal spring stiffness.

Referring again to FIGS. 1 and 2, although the arms 30, 30.1 are not strictly radial with respect to the journal bearing 42, it will be understood that their orientation is generally radial. For convenience the arms are referred to herein as radial arms.

The second ends 34, 34.1 of the arms 30, 30.1 on each side of the bogie are connected to one another by a force transmitting device 60 on the transverse centre line 26 of the bogie. The device 60 transmits forces between the arms to provide inter-axle shear stiffness for the bogie 10. It will however be understood that transverse forces transmitted between the ends 34, 34.1 of the arms will generate force couples on the journal roller bearings 42, particularly in shock load situations, which could result in premature failure thereof. For this reason, the design of the device 60 is such that, while it can transmit sufficient force between the arms for the bogie 10 to have adequate inter-axle shear stiffness for acceptable hunting stability and curving performance at design speeds, it does not transmit forces that could generate unacceptable couples on the journal roller bearings 42.

Figure 4:
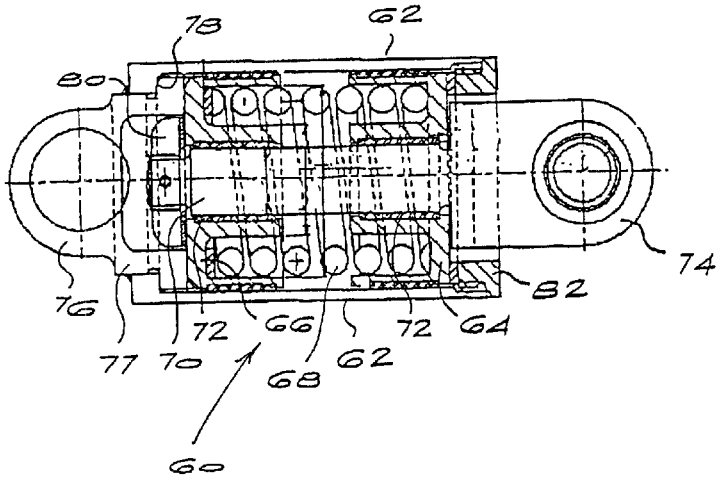
FIG. 4 illustrates a force transmitting device which can be used in the apparatus.

One example of a suitable device 60 is illustrated in FIG. 4 of the drawings. The device 60 seen in this Figure has a housing 62 accommodating sliding spring cups 64 and 66, a pretensioned compression spring 68 acting between the cups and a shaft 70 which can slide on bearings 72 through the cups 64 and 66. One end of the shaft carries an eye 74 which, in its application in the present invention, receives the end 34.1 of the arm 30.1. An eye 76 at the other end of the device 60 is fixed to the housing 62 by arms 77 and receives the end 34 of the arm 30. The relevant end of the shaft 70 is capable of longitudinal sliding movement relative to the eye 76.

In situations where the relevant forces transmitted by the radial arms 30, 30.1 tend to move the ends 34, 34.1 towards one another, the shaft 70 moves to the left in FIG. 4, taking the spring cup 64 with it and thereby applying a further compressive force to the spring 68. The spring cup 66 abuts a shoulder 78 at the end of the housing and does not move. At a limit position of movement of the shaft, a nut 80 on the shaft abuts the eye 76. If, on the other hand, the relevant forces transmitted by the arms 30, 30.1 tend to move the ends 34, 34.1 apart from one another, the shaft 70 will move to the right in FIG. 4. The nut 80 accordingly pulls the spring cup 66 to the right. The spring cup 64 abuts a shoulder 82 of the housing and cannot move so, once again, further compression is applied to the spring 68 in this situation.

The pretension applied to the spring 68 is such that the relative movement between the ends 34, 34.1 is very small compared to the deflection which the spring has already undergone in pretensioning it from a relaxed state. Thus the maximum force which the spring can transmit from one radial arm to the other does not substantially exceed the pretension force in the spring. In practice, the pretension force in the spring is set in the factory to a value at which it can transmit forces between the arms which are sufficient to give the required level of inter-axle stiffness for acceptable hunting stability and curving performance of the bogie 10, but which are insufficient to generate unacceptable couples on the journal bearings 42.

The force transmitting device 60 described above is only one example of how limited force transmission may take place between the arms. Other embodiments are described below with reference to FIGS. 7 to 12 and 17 to 21.

Specific reference has been made to the apparatus 12 being of a retro-fit design. The ability to retrofit an apparatus of this nature is of course advantageous. It will however be understood that in the case of new bogies, corresponding apparatus can be installed at the time of manufacture. In this case, the radial arms 30, 30.1 can be manufactured integrally as the wings of wing-type axle boxes. An example of such a construction is illustrated in FIGS. 5 and 6 which show radial arms 30, 30.1 formed integrally with wing-type axle boxes 20, 20.1.

Figures 5, 6:
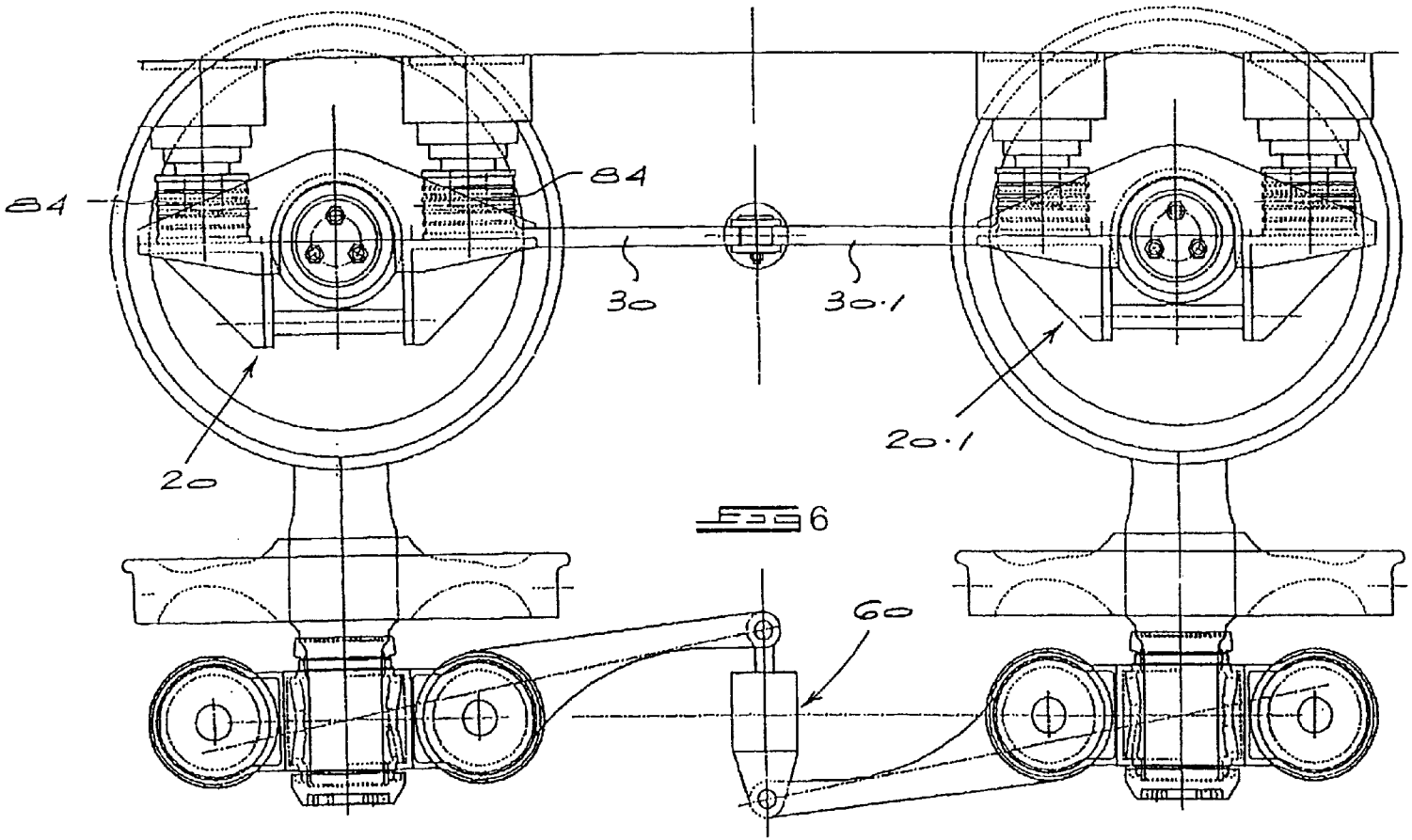
FIG. 5 shows a side view of a bogie manufactured with an apparatus according to the invention.
FIG. 6 shows a plan view of the embodiment of FIG. 5.

The wing-type axle boxes of the new bogie depicted in FIGS. 5 and 6 make use of two springs 84 per axle box, located respectively fore and aft of the vertical centre line, to achieve appropriate levels of longitudinal spring stiffness. However, bogies of original manufacture could also make use of a bearing adaptor and shear pad assembly located within the opening of the pedestal frame as described above for the retro-fit application. In these cases the radial arm could either be bolted on or made integral with the adaptor. Alternatively it would be possible in a new bogie to increase the size of the pedestal opening to accommodate a larger, single shear pad on the vertical centre line instead of an assembly of shear pads 50 as described above for the assembly 46. With a larger and softer single shear pad it would also be possible to achieve a softer longitudinal spring effect in order to improve the curving characteristics of the bogie.

A major advantage of the invention as exemplified above is that, while adequate inter-axle shear stiffness is provided, the arms 30, 30.1 can be of relatively lightweight construction, thereby adding relatively little to the unsprung mass of the bogie 10 compared to conventional designs. Although specific mention has been made of radial arms 30, 30.1 which are of angle section, it will be understood that channels, I-sections or other cross-sections could also be used.

It will be understood that the force transmitting device 60 of FIG. 4 has a very high level of initial stiffness to transmit lateral loads between the radial arms. After the initial spring pretension has been overcome there is little or no increase in the lateral loads which the device 60 can transmit between the radial arm, it being understood that the spring characteristic and the pretension applied thereto are set such that the lateral load which is transmitted after the pretension has been overcome is insufficient to cause damage to the journal bearings. While a high level of initial stiffness is appropriate to transmit the lateral load, it is however believed that a few millimeters of deflection should be allowed to take place.

Figure 7:
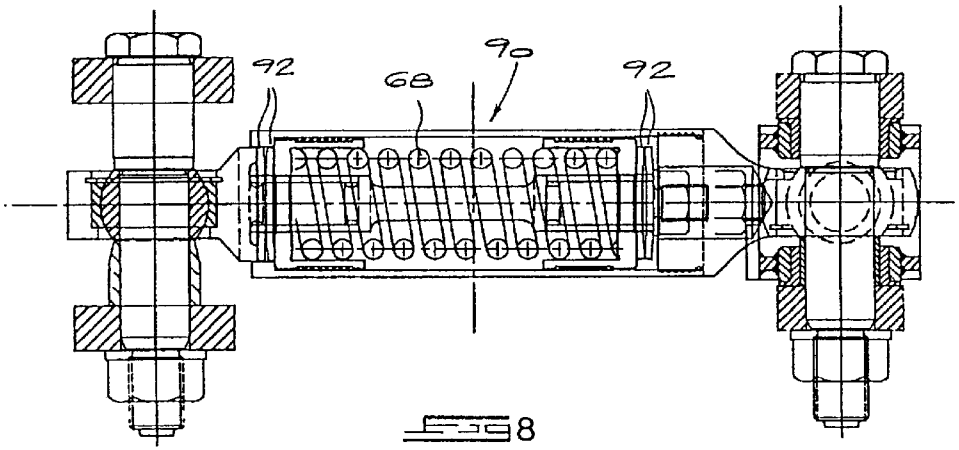
FIG. 7 illustrates another embodiment of force transmitting device which can be used in apparatus according to the invention.

FIG. 7 illustrates another force transmitting device 90, similar to the device 60, which allows for several millimeters of deflection prior to the pretension force in the coil spring 68 being overcome. In this case, the device 90 includes pairs of opposed Belleville or spring washers 92 at either end. The spring characteristic of the Belleville spring combinations is such they can accommodate a few millimeters of initial deflection in either direction.

FIG. 7 shows the pairs of Belleville washers with their concavities directed away from one another at one end and towards one another at the other end, but it will be understood that the arrangement could be the same at both ends.

As an alternative to Belleville washers, ring-shaped springs having an annular core of rubber or suitable polymer material, such as Vescoflex™, moulded between annular steel plates could be used.

Figure 8:
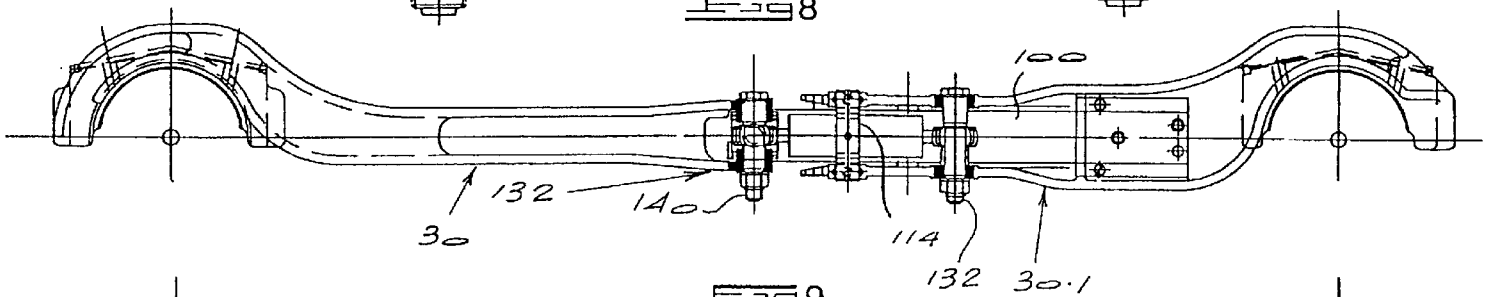
FIG. 8 shows a side view of relevant parts of another embodiment of the invention.
Figure 9:
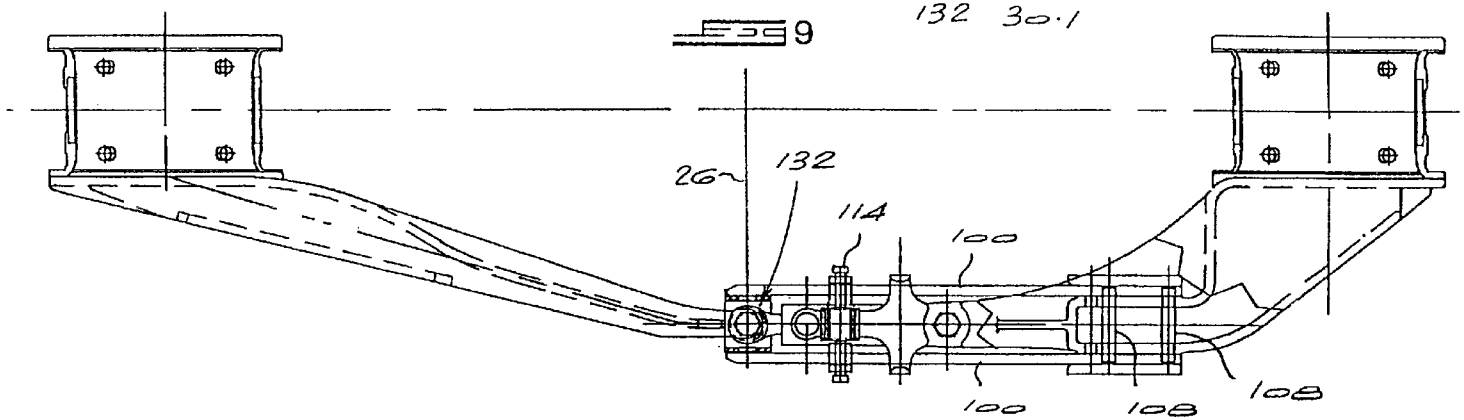
FIG. 9 shows a plan view of the components seen in FIG. 8.
Figure 10:
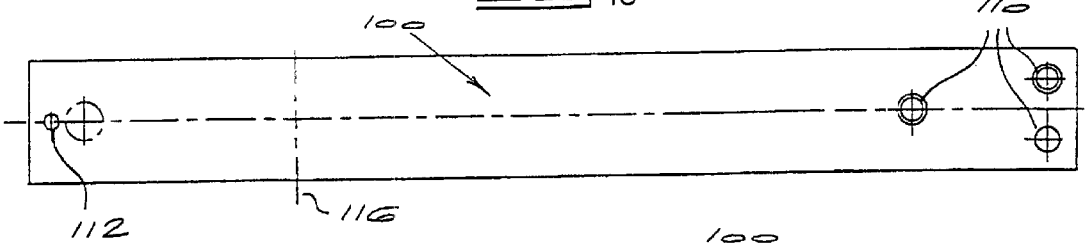
FIG. 10 shows a side view of a leaf spring used in the embodiment of FIGS. 8 and 9.
Figure 11:
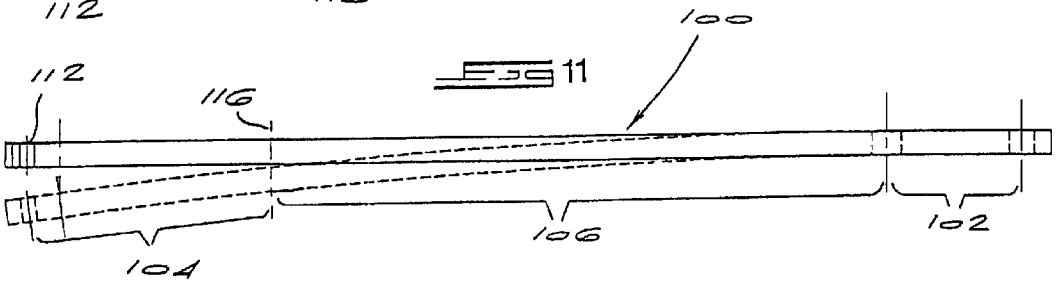
FIG. 11 shows a plan view of the leaf spring of FIG. 10.

FIGS. 8 and 9 illustrate another embodiment of the invention which uses a different type of force transmitting device in a radial arm configuration. This embodiment uses a pair of pretensioned leaf springs 100 as the force transmitting device. A typical one of these leaf springs is illustrated, in its manufactured state, in FIGS. 10 and 11. The spring 100 has straight ends 102 and 104 with a curved middle portion 106. The straight ends 102 of the springs 100 are clamped by bolts 108 extending through holes 110 to the radial arm 30.1 with the springs parallel to one another. The radial arm 30.1 in this case has a box section which accommodates the springs spaced apart laterally from one another.

A pulling device (not shown) is then inserted through holes 112 at the opposite ends of the springs. Tension is applied to the pulling device to pull the springs into a straight condition or even past straight. A stop 114 is fitted to each spring at a point 116 corresponding to the end of the portion 106 which was curved prior to the pretensioning operation just described.

Figure 16:
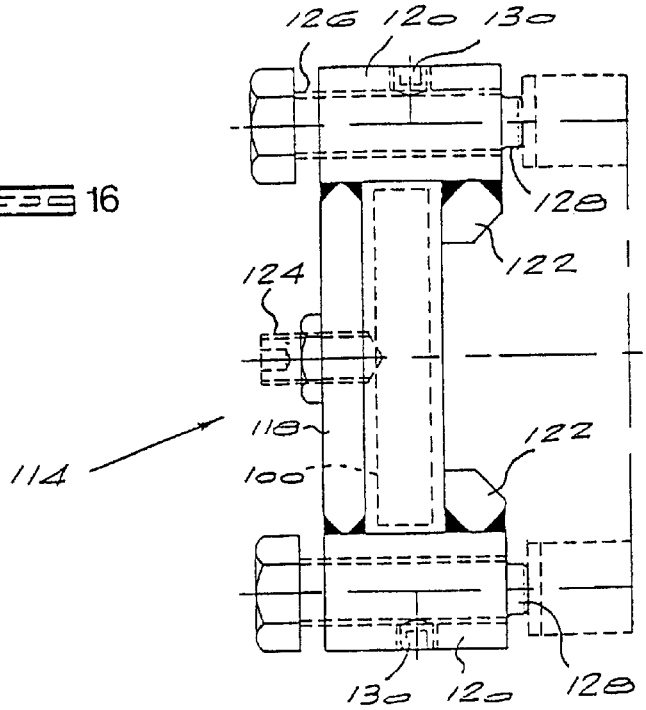
FIG. 16 illustrates a stop used in the embodiment of FIGS. 8 and 9.

An example of a suitable stop 114 is shown in FIG. 16 of the drawings. This stop 114 includes an upright plate 118 attached at its upper and lower ends to internally threaded members 120. Spaced apart from the plate 118 is a pair of lugs 122 also attached to the members 120. The leaf spring 100 can slide in the gap defined on one side by the plate 118 and on the other side by the lugs 122.

A set-screw 124 extending through a tapped hole in the plate 118 is used to anchor the stop to the leaf spring at the chosen position 116. Thus it will be understood that the stop is in fact slipped along the leaf springs 100 to the position 116 where they are anchored by means of the set-screws 124.

Set screws 126 extend through the members 120 as illustrated. Once the stops 114 have been fixed to the leaf springs at the correct positions, the projecting ends 128 of the set screws 126 bear against the upright walls of the box section radial arm 30.1. By adjusting the set screws 126 it is possible to bring the leaf springs into orientations in which they are straight and parallel to one another. The set screws are in turn locked in position by grub screws 130. The inner end of the other radial arm 30 carries a transverse member 132, termed a "crosshead", which is positioned on the transverse centre line 26 of the bogie and which locates slidably between the free ends of the leaf springs 100 projecting from the other radial arm. In situations where shear forces between the axles tend to move the adjacent ends of the arms 30, 30.1 towards or away from one another, the crosshead 132 will apply a force to one or other of the leaf springs in a manner tending to lift its stop 114 off the radial arm 30.1.

Because of the pretension force stored in each leaf spring and the bearing of the stops 114 against the radial arm 30.1, the free ends of the leaf springs act in the manner of pretensioned cantilevers having a length defined between the position 116 and the crosshead 132. Thus lateral force can be transmitted between the radial arms with little initial lateral deflection as initial loading up to the value of the pretension force takes place.

However, if the lateral force is sufficient to overcome the prestress in the relevant leaf spring, the set screws 126 of the stop 114 on that leaf spring will be lifted off the radial arm 30.1. Thereafter the full length of leaf spring acts in cantilever mode to take the applied lateral force. Clearly the shorter cantilever which acts initially is substantially stiffer than the longer cantilever which acts after the stop has been lifted. Accordingly the spring can flex more readily over its full length to take further applied loading without substantial transmission of the force between the radial arms 30, 30.1 after the stop has lifted.

Figure 12:
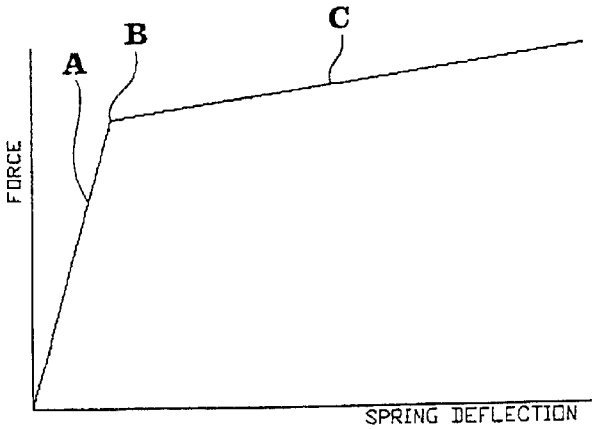
FIG. 12 graphically illustrates the performance of the embodiment of FIGS. 8 and 9.

This is illustrated in FIG. 12 which shows a theoretical plot of deflection on the horizontal axis against transmitted force on the vertical axis. In the initial stage A where the applied load is insufficient to overcome the prestress in the spring it will be seen that the spring can transmit a substantial load with very little deflection. In practice, as mentioned previously in connection with the device 60 of the first embodiment, it is desirable for there to be a few millimeters only of deflection during this stage.

The point B in the graph represents the point at which the applied load is equal to the prestress in the spring and the stop lifts off the radial arm. Thereafter in stage C the load which the spring can transmit increases only very slightly with increasing deflection.

As in the previous embodiments, the design is such that adequate lateral force can be transmitted during stage A to provide a suitable level of inter-axle shear stiffness. Thereafter the maximum transmitted force is insufficient to cause damage to the journal roller bearings.

Referring again to FIG. 7, the Belleville springs 92 provide the few millimeters deflection represented by stage A in FIG. 12.

An important advantage which the embodiment of FIGS. 8 and 9 has over that of FIGS. 4 and 7 is the fact that the leaf spring device is more compact in a lateral sense than the transverse coil spring device. The leaf spring device may accordingly be preferred in situations where there are obstacles close to the rail track which could interfere with a bogie fitted with a transversely extending device such as the devices 60.

Another advantage of the leaf spring device of FIGS. 8 and 9 is that the initial force required to lift the stop 114 off the radial arm 30.1 can be varied merely by varying the length of the lever arm defined between the position 116 and the crosshead 132, i.e. by varying the position of the stop on the leaf spring.

It will accordingly be understood that the use of leaf springs as described above lends itself to a particularly compact and versatile design able to provide both inter-axle shear stiffness and, as described below, a longitudinal yaw constraint.

Figure 13:
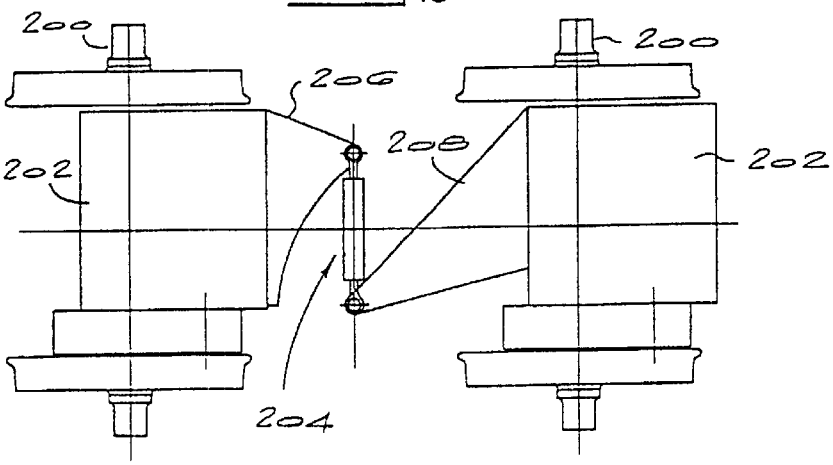
FIGS. 13 and 14 diagrammatically illustrate the application of the invention to motorised bogies.

The embodiments described above are applied to three-piece self-steering bogies. However the invention has wider application. FIG. 13 illustrates the application of the invention to a motorised, self-steering bogie having axles 200 fitted with motors 202. In this case, shear stiffness is provided by a transverse force transmitting device 204, corresponding to the device 60 used in the previous embodiments and acting on the transverse centre line of the bogie between fore-and-aft extending radial arms 206 and 208 corresponding to the arms 30, 30.1.

Figure 14:
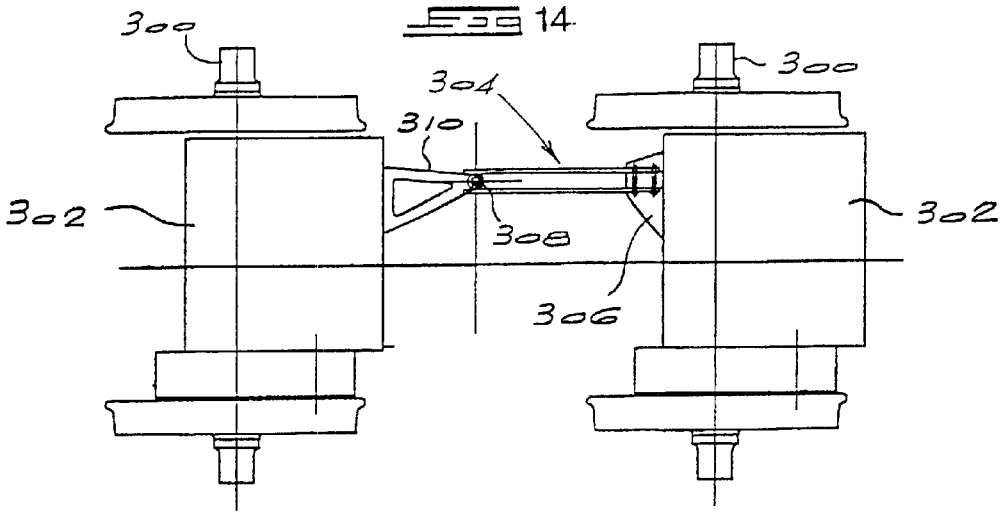

FIG. 14 illustrates the application of the invention to a motorised bogie having axles 300 fitted with motors 302. Shear stiffness in this case is provided by a leaf spring device 304 as described above in relation to FIGS. 8 and 9, the leaf springs being attached to an arm 306 extending rearwardly from one of the motor/axle assemblies and acting against a crosshead 308 carried on the transverse centre line of the bogie by an arm 310 extending forwardly from the other motor/axle assembly.

Figure 15:
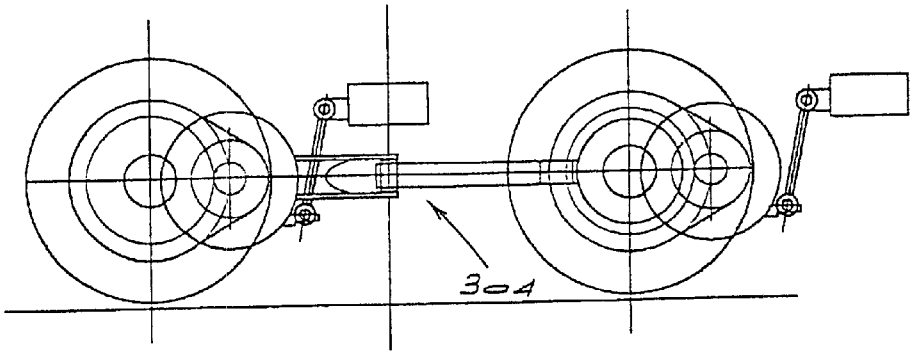
FIG. 15 shows a side view of the motorised bogie of FIG. 14.

From FIG. 15, which shows a side view of the motorised bogie of FIG. 14, it will be seen that the arms 306, 310 are radially orientated and corrrespond to the arms 30,30.1.

It will also be noted that in FIGS. 13 and 14 the force transmitting device is located inboard of the bogie wheels whereas in the previous embodiments, the devices are arranged outboard. Those skilled in the art will appreciate that inboard location is possible because of the inter-axle space which is available with motorised bogies.

Figure 17:
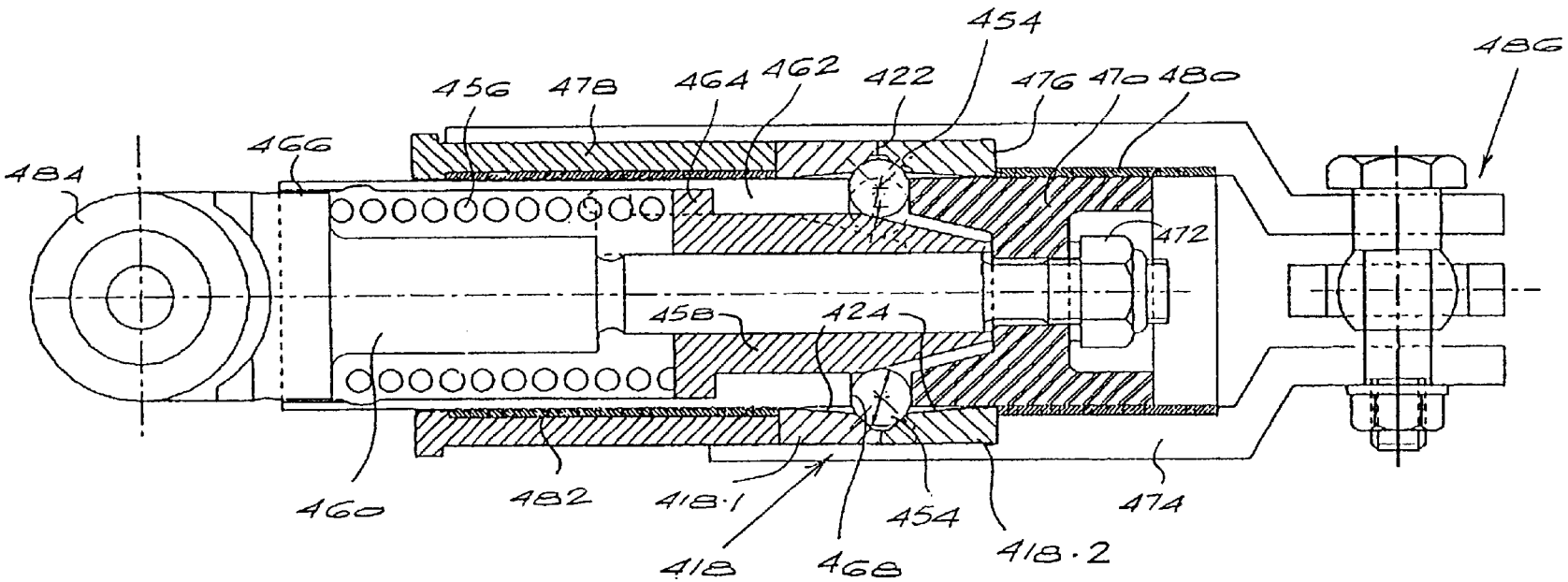

Other embodiments of force transmitting device, with a degressive characteristic, are illustrated in FIGS. 17 to 21. Referring to FIG. 17, there is an annular cam member 418 composed of mating cam segments 418.1 and 418.2 and a series of circumferentially spaced balls 454 which seat, in the dead centre position, in a recess 422 formed by the mating cam segments. A biasing force to hold the balls 454 in this position is provided by a spring 456 acting on a cone 458. The spring 456 surrounds a shaft 460 and is pretensioned by a sleeve 462 which acts against a shoulder 464 of the cone and screws onto the shaft at a thread 466. The balls 454 are retained between the end surface 468 of the sleeve and a piston 470 which is locked to the shaft by a lock nut 472 and which bears against the end face of the cone 458.

The dimensions are such that the ball-retaining gap between the opposing faces of the sleeve 462 and piston 470 is slightly greater than the ball diameter. Thus the balls are not tightly gripped between these faces and are able to move radially in the gap, as described below.

The cam segments 418.1, 418.2 are pressed into a cylinder 474 and are held between an internal shoulder 476 of the cylinder and an internal guide nut 478. Bushes 480 and 482 are provided in the cylinder 474 and in the sleeve 462 to allow for longitudinal sliding movement of the piston in the cylinder and of the sleeve in the guide nut respectively.

The shaft and cylinder carry respective couplings 484 and 486 by means of which they can be connected to members between which forces are to be transmitted, in the present case the inner ends 34, 34.1 of the rail arms 30, 30.1.

In the rest or dead centre position seen in FIG. 17 the balls 454 are retained in the recess 422 by the large diameter end of the conical surface of the cone 458. When relative movement takes place between the ends 34, 34.1 either towards or away from one another, the shaft 460 and cylinder 474 move relative to one another. Depending on the direction of relative movement, either the sleeve or the piston pushes on the balls. With application of a large enough force, the force of the spring 456 is overcome and the cone 458 slides on the shaft 460 to compress the spring further. The balls move out of the recess 422 and over the profiled cam surfaces 424. Since the balls are acted upon by progressively smaller diameters of the conical surface of the cone, there is a progressively diminishing, i.e. degressive, restoring force.

Figure 18:
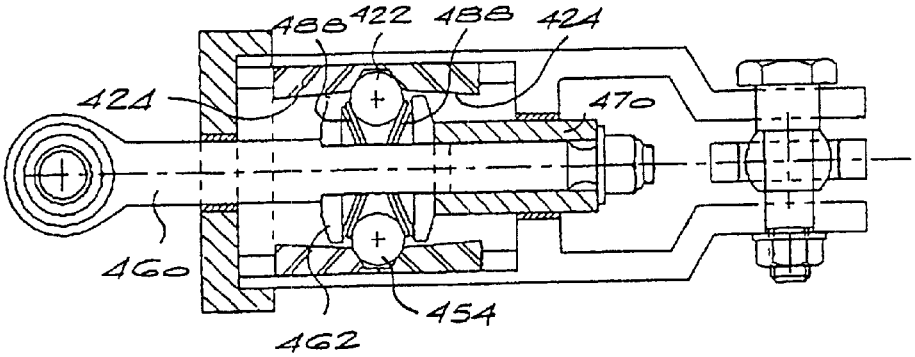
Figure 19:
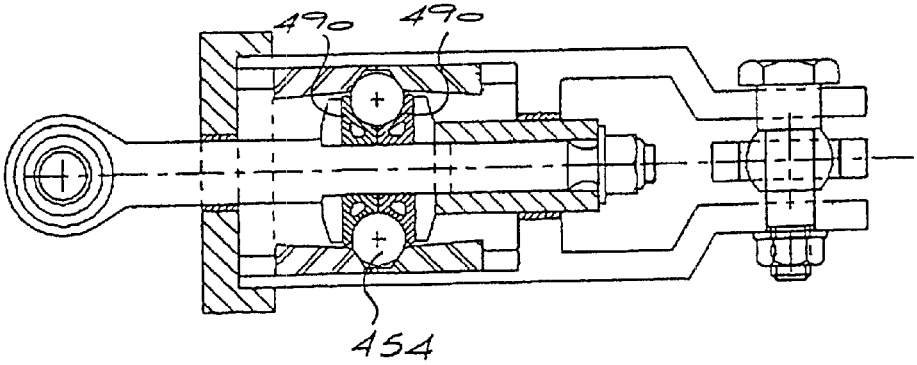

FIGS. 18 and 19 show modified versions of the FIG. 17 embodiment. Components corresponding to those in FIG. 17 are designated by like numerals. In FIG. 18, conical disc springs, i.e. Belleville springs 488, apply the necessary bias to the balls 454 in place of the cone and spring configuration of FIG. 17. In FIG. 19 rubber springs 490 are used in place of the disc springs 488. Despite the different spring arrangements employed in FIGS. 18 and 19 it will be appreciated that these embodiments operate in a fashion similar to FIG. 17, with the disc or rubber springs initially applying a large restraint to unseating of the balls from the recess 422 and thereafter the restoring force diminishes, i.e. degresses, with increasing deflection.

FIGS. 20 and 21 show another embodiment of force transmitting device which is an approximate reversal of the configuration in FIG. 17. Here, coil springs 492 in spring housings 494 on the cylinder 474 act inwardly on individual balls 454 to retain them in recesses 422 in the shaft 460 which can slide in the cylinder in bushes 496. As illustrated, there is a number of balls and corresponding springs which are circumferentially and longitudinally spaced apart from one another. In an alternative configuration there could be a plurality of balls spaced apart angularly in the same circumferential plane, i.e. without longitudinal spacing. This would decrease the overall length of the device.

It will be understood that the devices described above with reference to FIGS. 17 to 21 can be used as the force transmitting device in the earlier embodiments of FIGS. 1 and 2, FIGS. 5 and 6 or FIG. 13. As is the case with the previously described devices for this purpose, the characteristics of the force-transmitting devices of FIGS. 17 to 21 are such that a limited force can be transmitted between the radial arms 30 and 30.1 which is sufficient to achieve the required level of inter-axle stiffness but insufficient to place unacceptable couples on the journal roller bearings of the wheelsets, particularly in shock load conditions.

In addition to providing for transmission of a limited lateral force between the ends of the radial arms 30, 30.1, the devices of FIGS. 17 to 21 can also be used to provide degressive yaw constraints for the wheelsets of a rail bogie to ensure that on straight track there is a relatively high resistance to yawing of the wheelsets while on curved track, where yawing movements must be accommodated if the wheelsets are to attain radial orientations for proper self-steering to take place, a reduced resistance to yawing is required.

The degressive force transmitting devices of FIGS. 17 to 21 could, for instance, be arranged to act between the axle boxes of wheelsets on the same side of the bogie i.e. in the manner described with reference to FIG. 7 in the specification of South African patent 94/1641, to which reference should be made for the details. Alternatively such devices could be arranged to act between the bogie frame and the axleboxes of the wheelsets.

Figure 22:
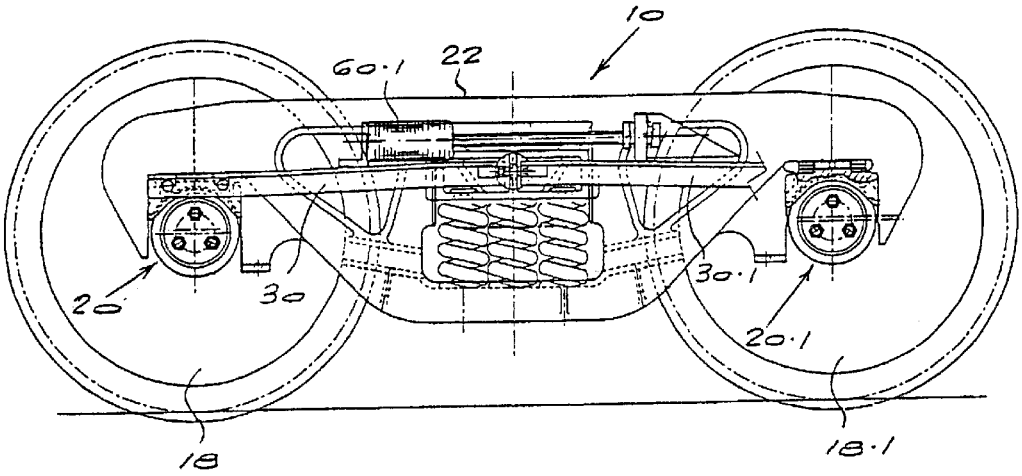
FIG. 22 shows a side view of an embodiment in which provision is made for axial shear stiffness and a yaw constraint.
Figure 23:
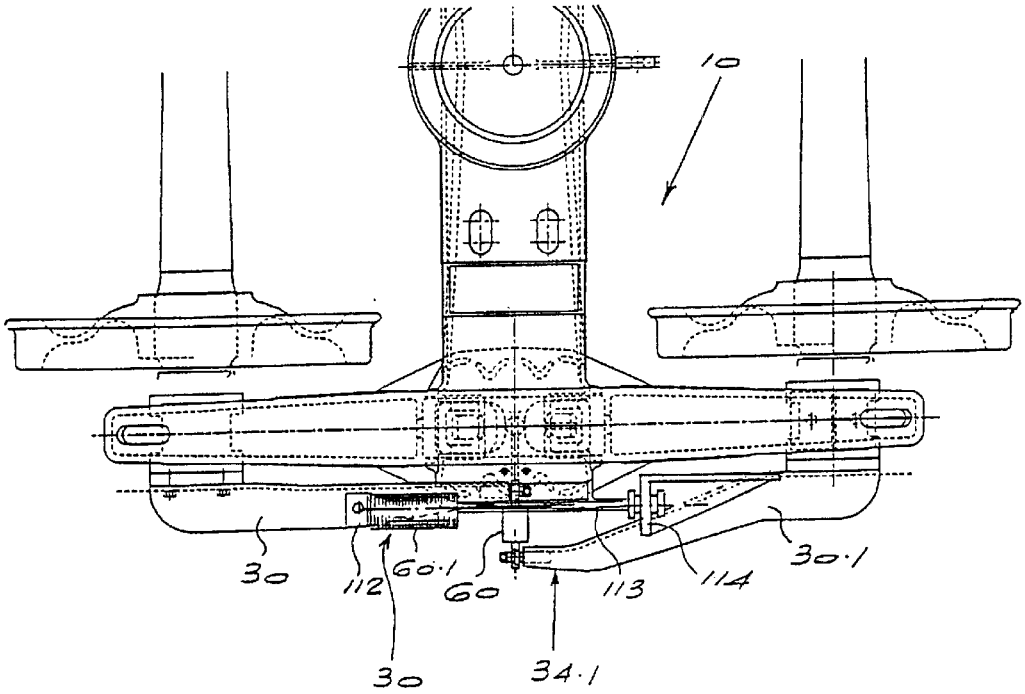
FIG. 23 shows a plan view of the embodiment of FIG. 22.

FIGS. 22 and 23 illustrate how degressive force transmitting devices such as those seen in FIGS. 17 to 21 can be used both to constrain wheelset yawing in a degressive manner and to provide inter-axle stiffness according to this invention. As before these Figures show a three piece, self steering bogie 10 with wheelsets 18, 18.1 journalled in axle boxes 20, 20.1 on which side frames 22 are suspended. Radial arms 30, 30.1 are connected to the axle boxes on each side of the bogie and extend towards one another with a force transmitting device 60 acting on the transverse centre line of the bogie between the adjacent ends 34, 34.1 of the radial arms. The device 60 may be any one of the degressive force transmitting devices described above with reference to FIGS. 17 to 21. The characteristics of the device, determined inter alia by the spring pretension force and the profile of the cam member against which the balls act, is set such that the maximum force which can be transmitted between the radial arms is sufficient to provide adequate inter-axle shear stiffness for hunting stability at high bogie speeds but insufficient to place unacceptable couples on the wheelset journal bearings.

Figure 24:
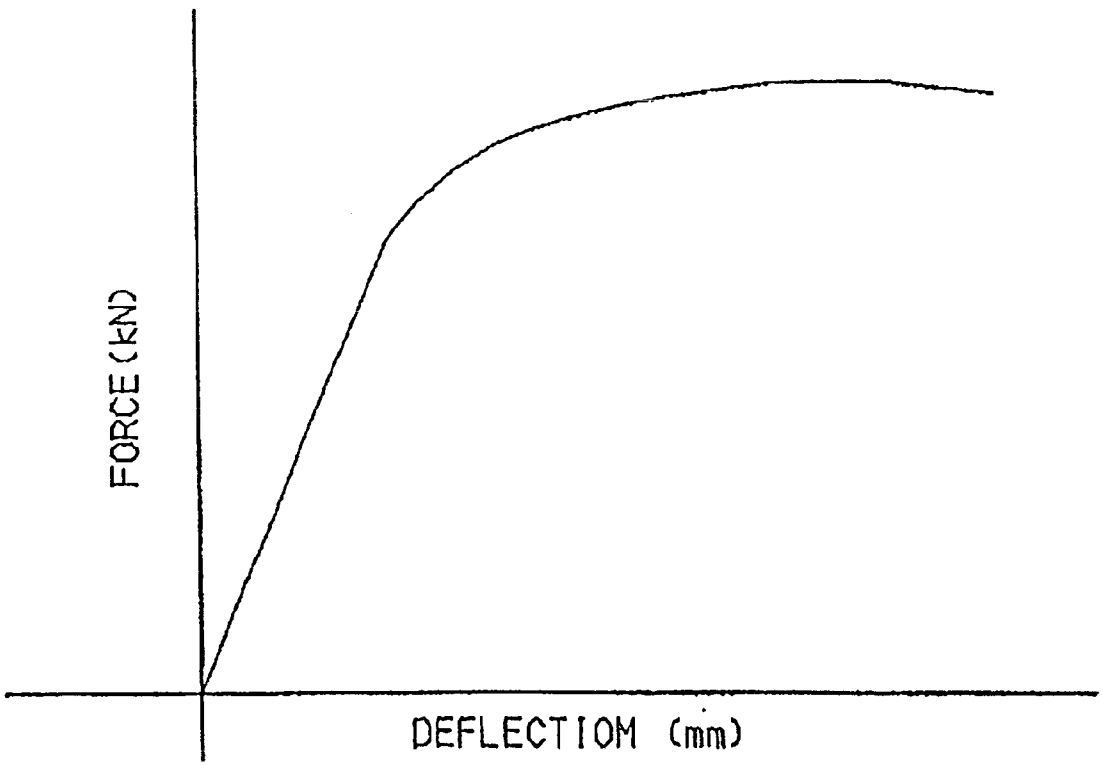
FIG. 24 graphically illustrates the performance of a device such as that seen in FIG. 17.

This is illustrated by FIG. 24 which shows a graph similar to that of FIG. 12. As shown here a large force can initially be transmitted with little deflection, i.e. movement of the ends 34, 34.1 of the radial arms 30, 30.1 towards or away from one another. Thereafter there is little or no increase in transmitted load with further deflection.

It will of course be understood that in each embodiment described above, the design of the force transmitting device is such that, irrespective of the amount of lateral movement between the adjacent ends of the radial arms, it is unable to transmit lateral forces which exceed a predetermined maximum force. The selected maximum force is great enough to generate a level of inter-axle shear stiffness consistent with acceptable hunting stability of the bogie but is insufficient to generate force couples on the axle box journal bearings which exceed what is considered to be an acceptable limit.

Referring again to FIGS. 22 and 23 another force transmitting device 60.1, similar to the device 60 and having a degressive characteristic as described above is used in the yaw constraint mode. It is seen acting between the radial arms 30, 30.1 with the cylinder of the device mounted to a bracket 112 on the radial arm 30 and the shaft 113 of the device connected to a bracket 114 on the other radial arm 30.1. The device 60.1 accordingly applies a double-acting degressive yaw constraint between the linked axleboxes.

FIGS. 26*a* and 26B, FIGS. 27*a* and 27*b* and FIGS. 28*a* and 28*b* illustrate three further embodiments of devices which can be used to provide a degressive yaw constraint feature in a self-steering bogie.

Figure 26B:
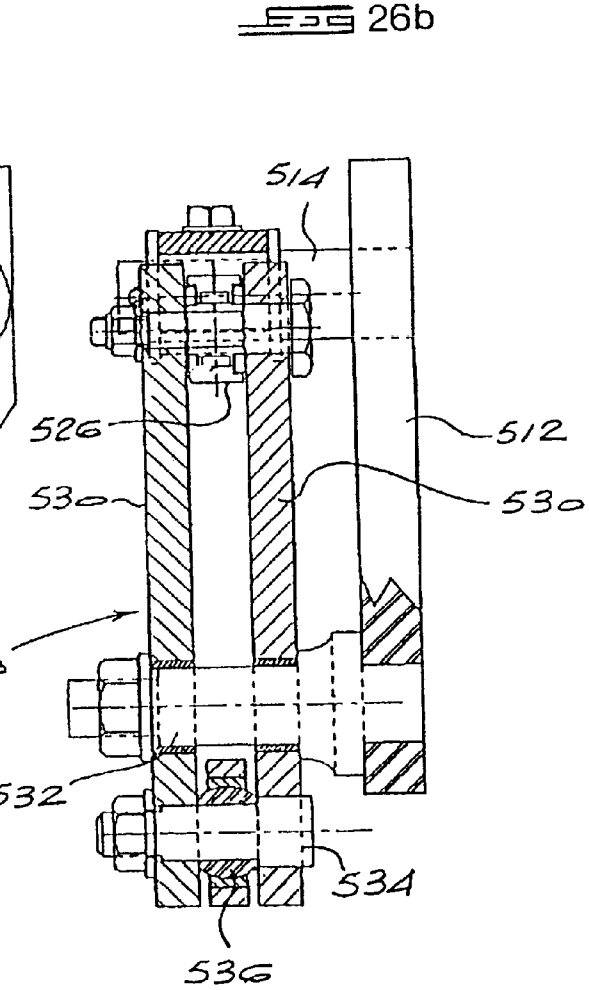
FIGS. 26*a* and 26*b* respectively show side and sectional views of another device which can be used to provide a degressive yaw constraint.
Figure 26A:
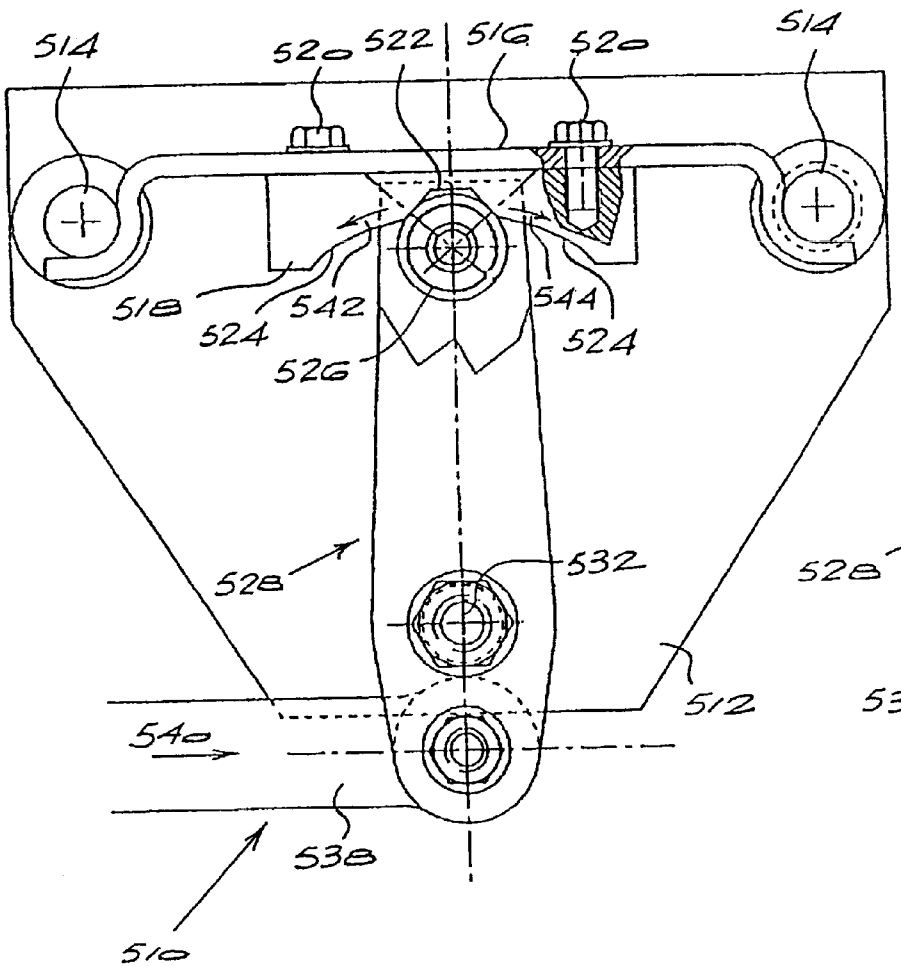

Referring firstly to FIGS. 26*a* and 26*b*, there is shown an embodiment 510 which includes a back plate 512 carrying spaced apart, projecting support pins 514 between which a leaf spring 516 is engaged. A cam member 518 is connected centrally to the leaf spring by studs 520. The cam member has a central recess 522 and profiled cam surfaces 524 arranged symmetrically on either side of the central recess.

The device 510 also includes a roller 526 carried rotatably by a lever 528 consisting of spaced apart arms 530 between which the roller is located. Between the roller and its lower end, the lever 528 is supported pivotally on a pin 532 projecting from the back plate 512. At the lower end of the lever a transverse pin 534 is attached via a spherical bearing 536 to the end of a link 538.

The device 510 serves to transmit forces between the link 538 and the back plate 512. In a practical application which the device is used to provide a longitudinal yaw constraint, the back plate may be fixed to or be part of the bogie frame with the link 538 being an axle box link extending from an axle box. The device 510 then serves to transmit longitudinal forces between the axle box and the bogie frame to provide a degressive yaw constraint for the relevant axle to improve hunting stability.

FIG. 26*a* shows the device at a central or dead centre position with the roller 526 seated in the recess 522. The roller is held in this position by the action of the leaf spring 516, which is pretensioned to provide a predetermined biasing force. Movement of the axle box link, for instance in the direction indicated by the arrow 40, in response to yawing movement of the associated axle relative to the bogie frame, causes the lever 528 to rotate about the axis of the pin 532. There is initially considerable resistance to this movement as a result of the seating of the roller in the recess 522. However if the force applied by the link 538 is sufficient to unseat the roller from the recess, there will be a progressively decreasing restoring force, i.e. a degressive resistance, as the roller moves over the relevant cam surface as indicated by the arrow 542. The device 510 accordingly transmits the force from the link to the back plate, i.e. from the axle box to the bogie frame, in a degressive manner with the magnitude of the transmitted force decreasing with increasing movement of the link.

It will be understood that if the link 538 moves in the opposite direction with sufficient force to unseat the roller from the recess, there will be a similar degressive restraint as the roller moves over the other cam surface 524 in the direction of the arrow 544. Thus it can be seen that the device 510 is double-acting in the sense that the degressive restraint is applied irrespective of the direction of relative movement between the axle box link 538 and the back plate.

Figure 27A:
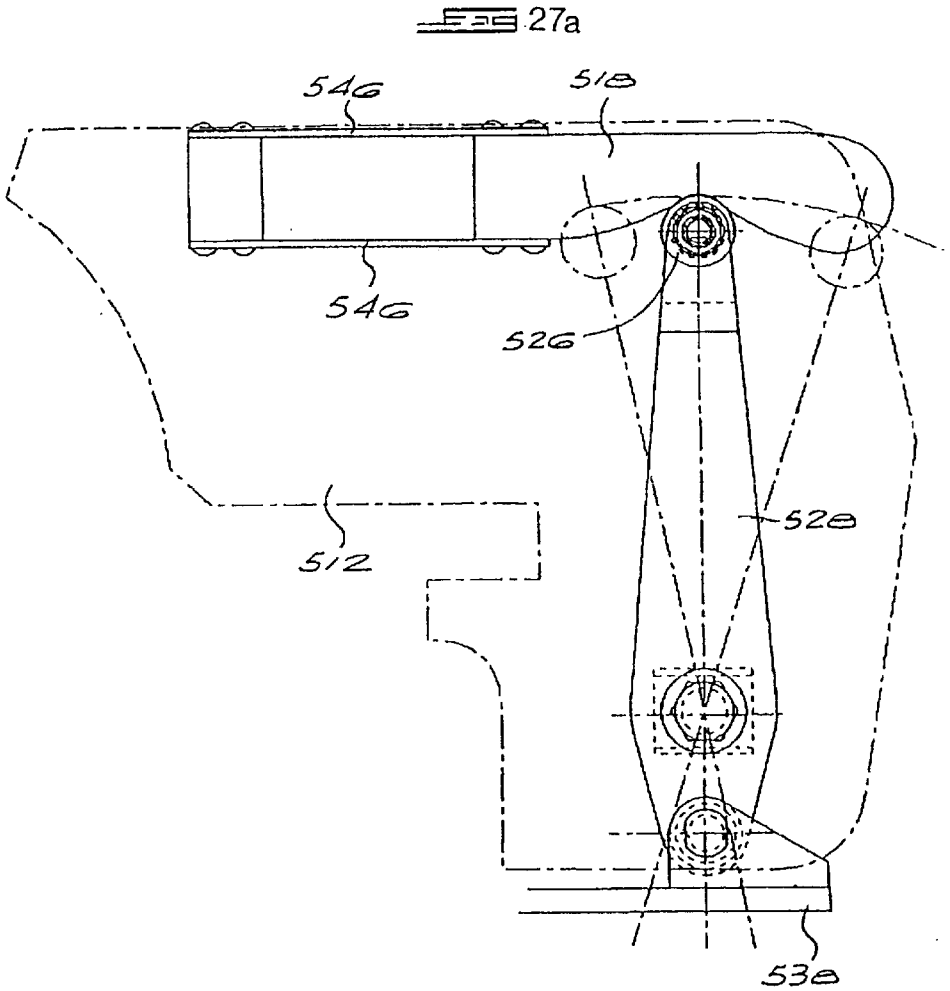
FIGS. 27*a* and 27*b* respectively show side and sectional views of a further device which can be used to provide a degressive yaw constraint.
Figure 27B:
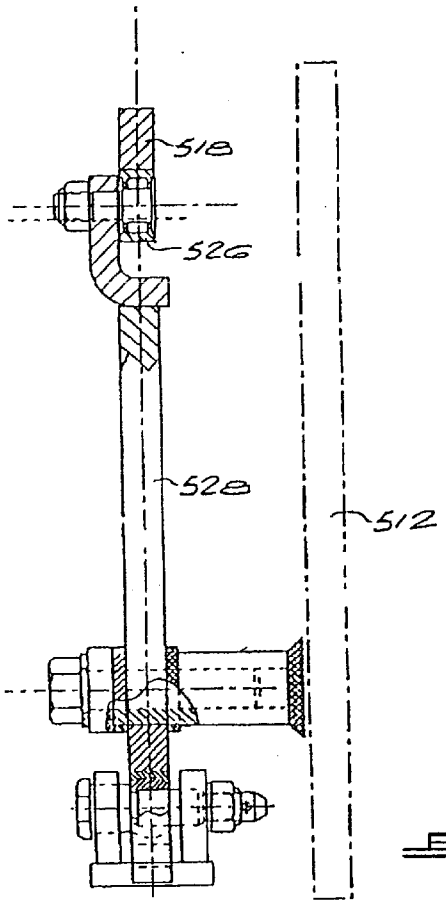

Components in FIGS. 27*a* and 27*b* which correspond to those in FIGS. 26*a* and 26*b* are designated by the same reference numerals. In this case the cam member 518 is clamped between two spring blades 546 supported by the back plate 512. There is once again a roller 526 carried by a lever 528.

In the practical example mentioned above, forces are again transmitted between an axle box to which the link 538 is connected and a bogie frame in a degressive manner, with an initially large resistance to unseating of the roller 526 and thereafter a progressively diminishing restoring force as the roller moves further and further along one or other of the cam surfaces 524 with increasing movement of the link 538, i.e. with increased yawing movement of the axle.

Figure 28A:
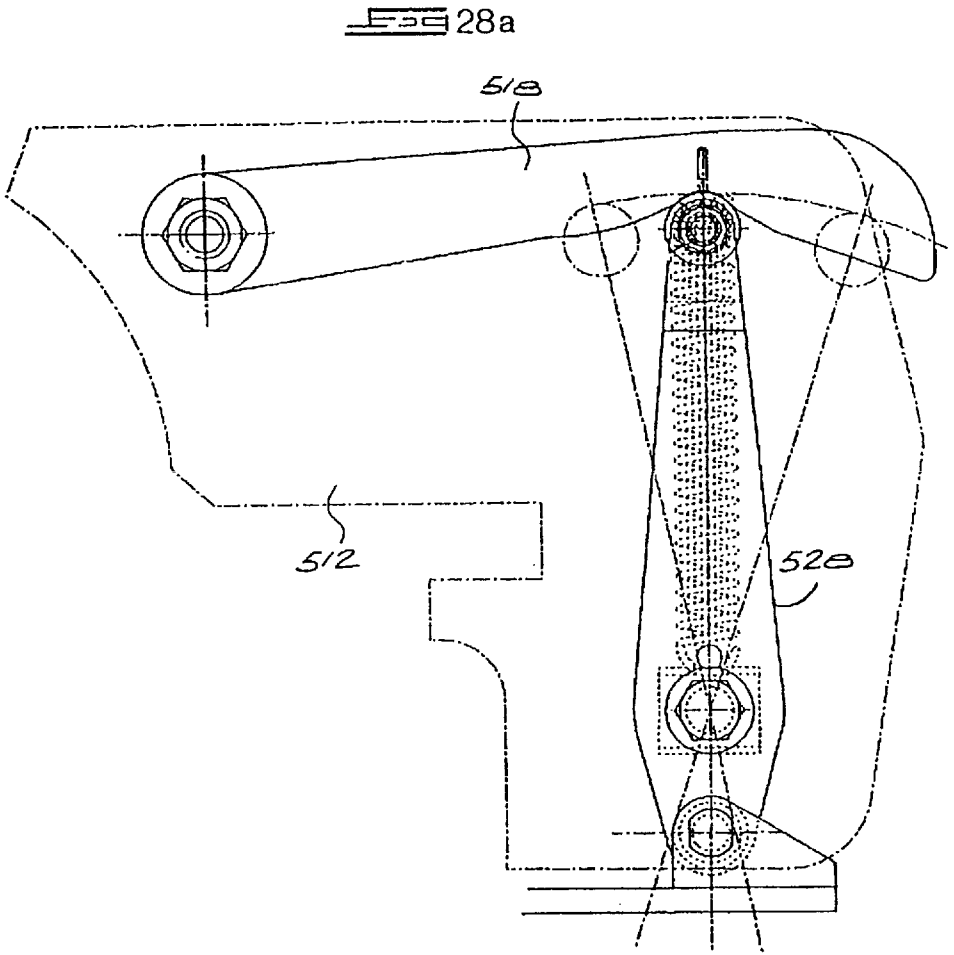
FIGS. 28*a* and 28*b* respectively show side and sectional views of yet another device which can be used to provide a degressive yaw constraint.
Figure 28B:
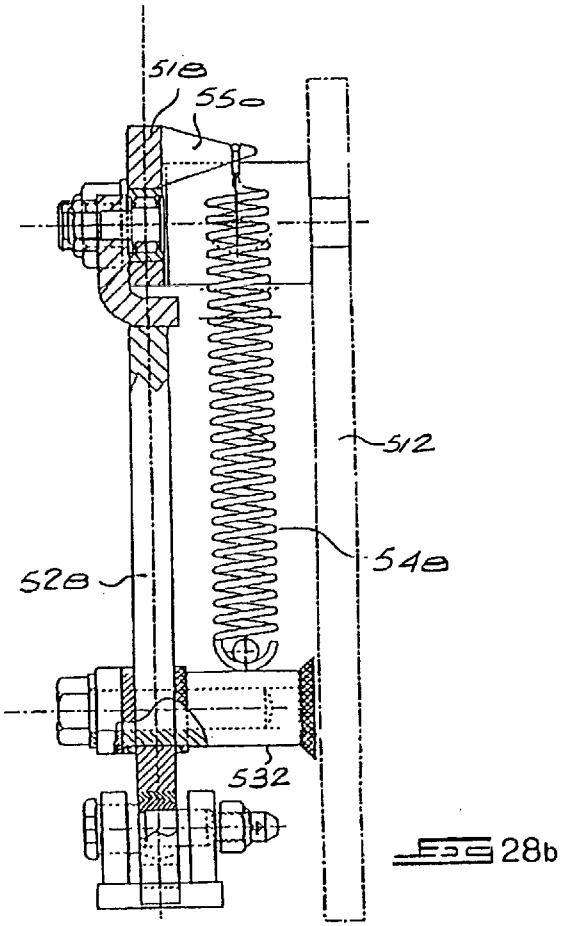

In FIGS. 28*a* and 28*b*, like components are again designated with like reference numerals. In this case, the leaf or blade springs of the embodiments of FIGS. 26 and 27 are replaced by a pretensioned coil spring 548 which acts between the pivot pin 532 and a lug 550 on the cam mbmer 518 which is pivoted to the back plate 512 at a pivot 552.

In FIGS. 26 to 28 the spring force will in each case be kept as low as practically possible to reduce wear on the roller 526 while nevertheless catering for the transmission of appropriate yaw constraining forces in the required, degressive manner.

In the context of a longitudinal yaw constraint and referring again to the embodiment seen in FIGS. 8 and 9 an added advantage is the ability to accommodate a longitudinal yaw constraint device between the leaf springs. The yaw constraint could, for instance, be similar to that illustrated in FIGS. 22 and 23. In the proposed arrangement one end of the degressive yaw constraint would be attached to a vertical pin 140 forming part of the crosshead 132 and the opposite end to another pin 142 extending vertically through the radial arm 30.1 between the springs 100. It will be appreciated that in this way both inter-axle shear stiffness and a longitudinal yaw constraint can be provided very compactly.

I claim:

1. An inter-axle shear stiffening apparatus for a self-steering rail bogie having axle structures including axles which are journalled in axle box bearings, the apparatus comprising arms which are rigidly connected or connectable to respective axle structures of the bogie to extend towards one another from the axle structures in generally fore and aft directions, and lateral force transmitting means for acting between the arms to transmit lateral forces between them while accommodating relative lateral movement between the arms, wherein, irrespective of the extent of relative movement between the arms, the lateral force transmitting means is only capable of transmitting between them lateral forces of limited, predetermined magnitude which provide the bogie with inter-axle shear stiffness to enhance hunting stability of the bogie but are insufficient to impose excessive force couples on the axle box bearings.

2. An apparatus according to claim 1 wherein the lateral force transmitting means is arranged to transmit lateral forces between adjacent ends of the arms substantially on a transverse centre line of the bogie between the axles.

3. An apparatus according to claim 2 wherein the lateral force transmitting means is arranged to transmit lateral forces between the arms substantially in the plane of the axle box bearings.

4. An apparatus according to claim 1 wherein the arms are arranged to be substantially radially oriented with respect to the axles.

5. An apparatus according to claim 1 wherein the lateral force transmitting means is arranged initially to transmit between the arms relatively large lateral forces, up to the predetermined magnitude, for relatively small relative movement between the arms and thereafter to transmit little or no further forces between the arms for relatively large relative movement between the arms.

6. An apparatus according to any one of the preceding claims wherein the lateral force transmitting means includes a spring to resist relative lateral movement between the arms, the spring being pretensioned to a value not substantially less than the predetermined magnitude.

7. An apparatus according to claim 6 wherein the spring is a coil spring.

8. An apparatus according to claim 6 wherein the spring comprises one or more leaf springs.

9. An apparatus according to any one of claims 1 to 5 wherein the lateral force transmitting means comprises a cam member presenting a cam surface in which a recess is formed, a detent and spring means biasing the detent to seat it in the recess, the detent when seated in the recess resisting relative movement between the arms while lateral forces are transmitted between them, with the arrangement being such that on transmission of lateral forces between the arms of the predetermined magnitude the detent is unseated from the recess and moves over the cam surface with little further transmission of lateral force between the arms.

10. A self-steering rail bogie, comprising:

at least two axle structures including axles journalled in axle box bearings; and an inter-axle shear stiffening apparatus, said inter-axle shear stiffening apparatus comprising:

an arm rigidly connected or connectable to each of said at least two axle structures of the bogie, said arms extending toward one another from said axle structures;

a lateral force transmitting connector connected between and acting between the arms to transmit lateral forces between said arms such that, irrespective of the extent of relative movement between said arms, the lateral force transmitting connector transmits lateral forces of limited predetermined magnitude, said transmitted lateral forces being sufficient to provide inter-axle shear stiffness to enhance the hunting stability of the bogie but insufficient to impose excessive force couples on the axle box bearings.

11. A self-steering rail bogie according to claim 10 wherein the bogie is a three piece bogie.

12. A self-steering rail bogie according to claim 11 which comprises an inter-axle shear stiffening apparatus located outboard of wheels carried by the axles on each side of the bogie.

13. A self-steering rail bogie according to claim 10 wherein the bogie is a motorised bogie.

14. A self-steering motorized rail bogie, comprising:

at least two axle structures including axles journalled in axle box bearings, wherein said axles carry wheels; and an inter-axle shear stiffening apparatus, wherein the inter-axle shear stiffening apparatus is located inboard of said wheels, said inter-axle shear stiffening apparatus comprising:

an arm rigidly connected or connectable to each of said at least two axle structures of the bogie, said arms extending toward one another from said axle structures;

a lateral force transmitting connector connected between and acting between the arms to transmit lateral forces between said arms such that, irrespective of the extent of relative movement between said arms, the lateral force transmitting connector transmits lateral forces of limited predetermined magnitude, said transmitted lateral forces being sufficient to provide inter-axle shear stiffness to enhance the hunting stability of the bogie but insufficient to impose excessive force couples on the axle box bearings.

15. A self-steering rail bogie according to any one of claims 10 to 14 and comprising degressive yaw constraint means acting between the axles to constrain yawing movements between the axles.

16. An inter-axle shear stiffening apparatus for a self-steering bogie having first and second axle structures including axles that are journalled in axle box bearings, comprising:

a first arm rigidly connected or connectable to the first axle;

a second arm rigidly connected or connectable to the second axle, said first and second arms extending toward each other when connected to the first and second axles, respectively;

a lateral force transmitting connector connected between said first and second arms, said lateral force transmitting connector including a stiffening mechanism that transmits between said arms lateral forces having magnitudes less than a predetermined value for relatively small relative movement between the arms and transmits between said arms little or no lateral forces having magnitudes greater than said predetermined value, even for relatively large relative movement between said arms.

17. An inter-axle shear stiffening apparatus for a self-steering bogie having first and second axle structures including axles that are journalled in axle box bearings, comprising:

a first arm rigidly connected or connectable to the first axle;

a second arm rigidly connected or connectable to the second axle, said first and second arms extending toward each other when connected to the first and second axles, respectively;

a lateral force transmitting connector connected between said first and second arms, said lateral force transmitting connector including a stiffening mechanism that transmits between said arms lateral forces having magnitudes less than a predetermined value for relatively small relative movement between the arms and transmits between said arms little or no lateral forces having magnitudes greater than said predetermined value, even for relatively large relative movement between said arms, wherein said lateral force transmitting connector comprises a spring, said spring being pretensioned with a force that is not substantially less than said predetermined value.

18. An inter-axle shear stiffening apparatus for a self-steering bogie having first and second axle structures including axles that are journalled in axle box bearings, comprising:

a first arm rigidly connected or connectable to the first axle;

a second arm rigidly connected or connectable to the second axle, said first and second arms extending toward each other when connected to the first and second axles, respectively;

a lateral force transmitting connector connected between said first and second arms, said lateral force transmitting connector including a stiffening mechanism that transmits between said arms lateral forces having magnitudes less than a predetermined value for relatively small relative movement between the arms and transmits between said arms little or no lateral forces having magnitudes greater than said predetermined value, even for relatively large relative movement between said arms, wherein said lateral force transmitting connector comprises:

a cam having a cam surface that includes a recess therein;

a detent seated in said recess; and a spring urging said detent and said cam together such that said detent resists relative movement and transmits lateral forces between said arms when seated in said recess as long as the lateral forces are less than said predetermined value and unseats from said recess and transmits substantially no further lateral forces when the lateral forces exceed said predetermined value.

* * * * *